US008151658B1

(12) United States Patent
Ding

(10) Patent No.: US 8,151,658 B1
(45) Date of Patent: Apr. 10, 2012

(54) DING INSPECTION DEVICE

(75) Inventor: John Ding, Midlothian, VA (US)

(73) Assignee: John Z. Ding, Midlothian, VA (US)

( * ) Notice: Subject to any disclaimer, the term of this patent is extended or adjusted under 35 U.S.C. 154(b) by 0 days.

(21) Appl. No.: 12/888,500

(22) Filed: Sep. 23, 2010

(51) Int. Cl.
*E21B 47/00* (2012.01)

(52) U.S. Cl. ..... 73/865.8

(58) Field of Classification Search ..... 73/865.8; 382/109

See application file for complete search history.

(56) References Cited

U.S. PATENT DOCUMENTS

| | | | | |
|---|---|---|---|---|
| 7,187,784 | B2 * | 3/2007 | Tawfiq et al. | 382/109 |
| 2004/0160514 | A1 * | 8/2004 | Tawfig et al. | 348/85 |
| 2007/0127780 | A1 * | 6/2007 | Tawfiq et al. | 382/109 |

* cited by examiner

*Primary Examiner* — John Fitzgerald

(57) ABSTRACT

Visual inspection of an interior bottom of a borehole by means of measuring the sediment thickness at the bottom. An inspection device to be lowered in the borehole and then to be retrieved. The bottom sediment thickness is marked on the piston by a collar attached to the piston.

7 Claims, 7 Drawing Sheets

DING INSPECTION DEVICE

NOT TO SCALE

NOTE:
ALL PARTS SHOULD BE MADE OF STEEL EXCEPT FOR THE BOTTOM PLATE AND SLIDING COLLAR (SEE FIG 7 FOR DETAILS)

VIEW A–A FROM FIG. 5

NOT TO SCALE

NOTE:

ALL PARTS SHOULD BE MADE OF STEEL EXCEPT FOR THE SLIDING COLLAR (SEE FIG 6 FOR DETAILS)

DING INSPECTION DEVICE

CROSS-REFERENCE TO RELATED APPLICATIONS

None

STATEMENT REGARDING FEDERALLY SPONSORED RESEARCH (IF APPLICABLE)

The invention was not made under a government contract, or federal fund.

BACKGROUND OF THE INVENTION

As a critical part of the drilled shaft quality control (FHWA, 1999), inspecting the bottom cleanliness of drilled shafts has always been challenging to contractors, engineers, and field inspectors, especially in the situation of the wet construction method, when direct visual inspections are impossible. Even with the dry construction method, inspectors have been reluctant to inspect the bottom visually due to safety concerns. On the other hand, most federal and local agencies, such as states' department of transportation and city building authorities specify that drilled shafts be inspected for bottom cleanliness. Typically, a minimum of 50 percent of the base of each shaft should have less than 0.5 inch of sediment at the time of concrete placement, and the maximum depth of sediment or any debris at any place on the base of the shaft is not allowed to exceed 1.5 inches. Conscientious cleaning of the bottom of drilled shafts has been proven by loads tests to be necessary for suitable load transfer in end bearing.

Currently, the Shaft Inspection Device (SID) or Miniature Shaft Inspection Device (Min-SID) are the only devices recognized as being relatively accurate to measure the drilled shaft bottom sediment without an inspector's direct measurement in the hole.

SID was developed in the early 1980s by Schmertmann and Crapps, Inc. The SID comprises a television camera sealed inside a water-tight jacket and is used for inspecting both dry and wet excavations. The concept of the SID was derived from an Australian drilled shaft inspection device originally developed by Dr. Jim Holden of the Country Roads Board. SID is a heavy (over 1000 lb) and large equipment. The operation is relatively expensive and time consuming.

Mini-SID was introduced around 1998 with much lighter weight and easier operation procedures. However, it still involved the operations of specifically trained personnel and relatively time consuming test procedures.

Given these reasons, a portable drilled shaft inspection device with improved efficiency is desired. The device should have the following key points:

1. Simple Operating Process
2. Very Efficient
3. High Reliability

SUMMARY OF THE INVENTION

Embodiments of the invention include a mechanical device of approximately 20 pounds (9 kg). The dimensions of the device are approximately 7.5 inches (188 mm) in diameter, and 9 inches (225 mm) high. The device provide following benefits for the drilled shaft inspection:

1. No need of the human excess into the boring hole
2. Acceptable accuracy of the measurement of the drilled shaft bottom sediments.
3. A pure mechanical device operated as a hand tool.

4. Easy operating procedures without the need of specially training personnel to use the device.
5. Dramatically improved efficiency.

DETAILED DESCRIPTION OF INVENTION

Figure 1:
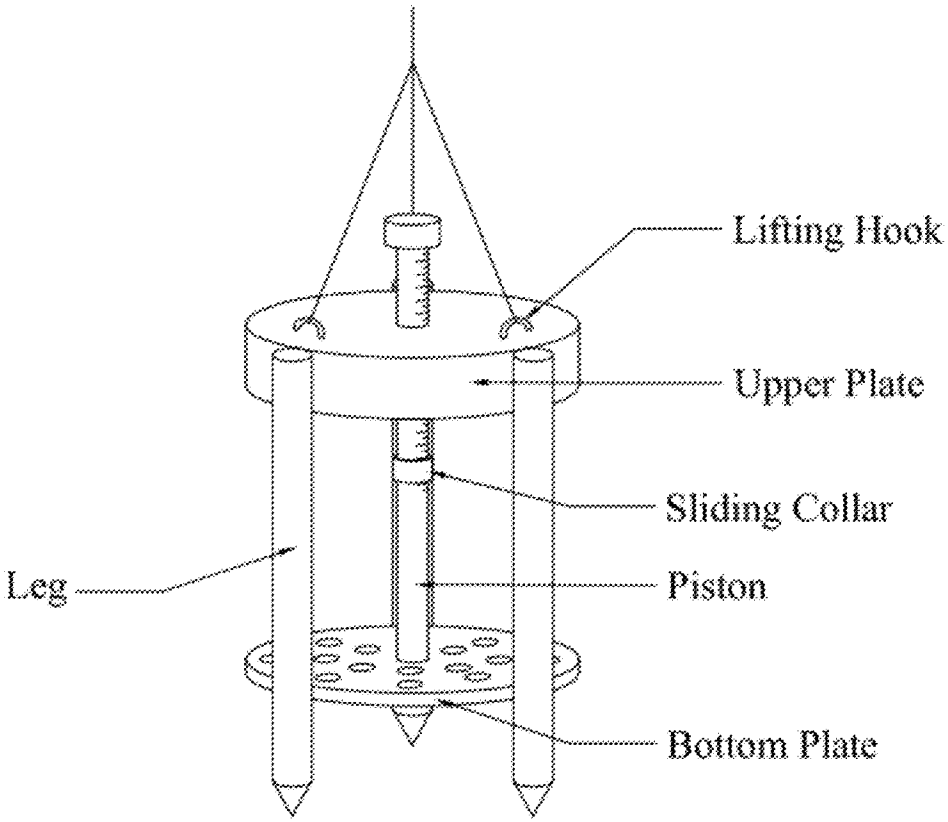
FIG. 1 is the schematic sketch of the device

Referring to the drawings, FIG. 1 illustrates the schematic sketch of the Ding Inspection Device (DID). As shown, the system includes a steel upper plate, three steel legs attached to the upper plate, a steel piston with imprinted marks of 0.25 inches increments, an aluminum sliding collar with a rubber O-ring embedded inside the collar, an aluminum bottom plate with 16 0.5"-diameter holes, three lifting holes attached to the upper plate.

The inspection procedure includes six essential steps:

1. Set the device on a level flat solid area so that the bottom of the plate is level with the tips of the three legs.
2. Set the "zero" reading by pushing the collar on the piston until it touches the bottom of the upper plate. The "zero" reading is at the bottom of the collar.
3. Slowly lower the device into the drilled shaft. If there is liquid in the shaft, careful attention should be paid to the moment when the bottom plate comes in contact with the liquid so that the impact pressure of the liquid does not move the plate up. As a reference, the drop speed of the device should be less than 0.1 inch/second at the moment when the plate contacts the liquid surface and the maximum speed for the device in the liquid should be less than 3.5 inch/second (Approximately 3 minutes for a slurry shaft of 50 feet deep).
4. After the device is set at the drilled shaft bottom, retrieve the device.
5. Take reading at the bottom of the collar.
6. Repeat steps 1 to 5 if additional readings are required.

Figure 2:
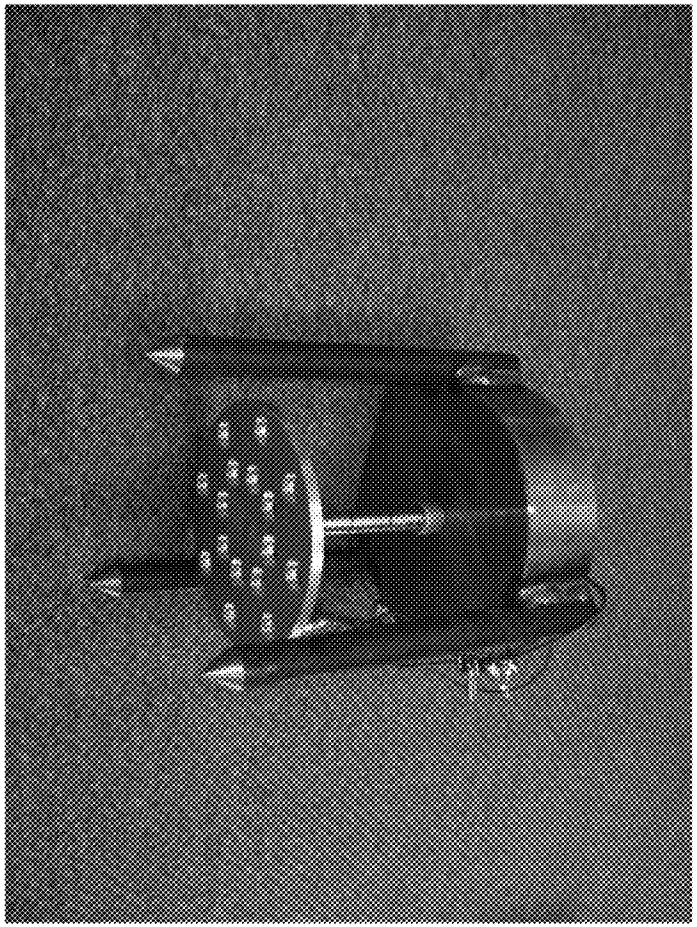
FIG. 2 is a picture overview of the device.

FIG. 2 is a photographic overview of the device.

Figure 3:
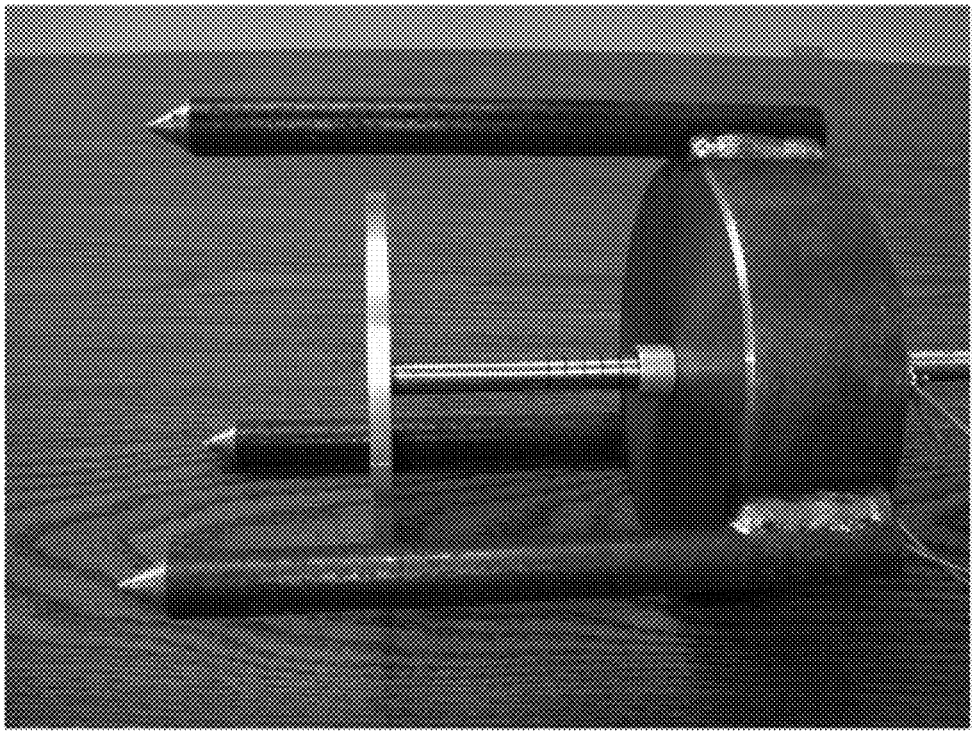
FIG. 3 is a picture side view of the device showing the details of the collar and the imprinted marks on the piston.

FIG. 3 is a photographic side view of the device showing the details of the collar and the imprinted marks on the piston.

Figure 4:
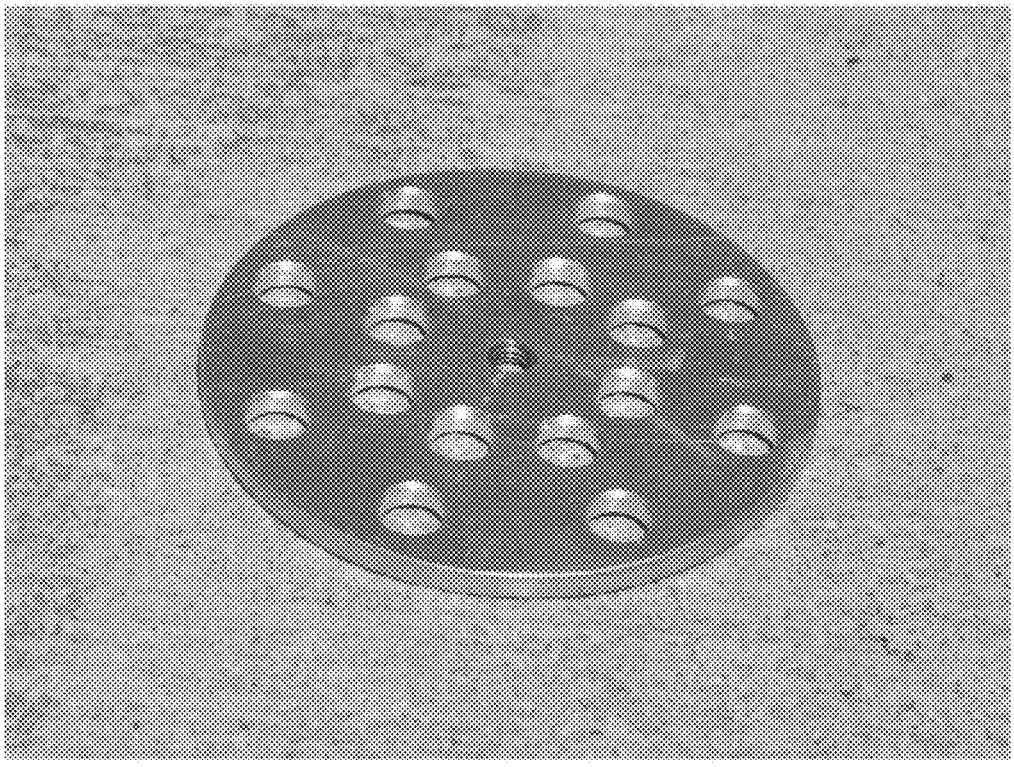
FIG. 4 is the picture for the replaceable bottom plate.

FIG. 4 is the photographic view for the replaceable aluminum bottom plate.

Figure 5:
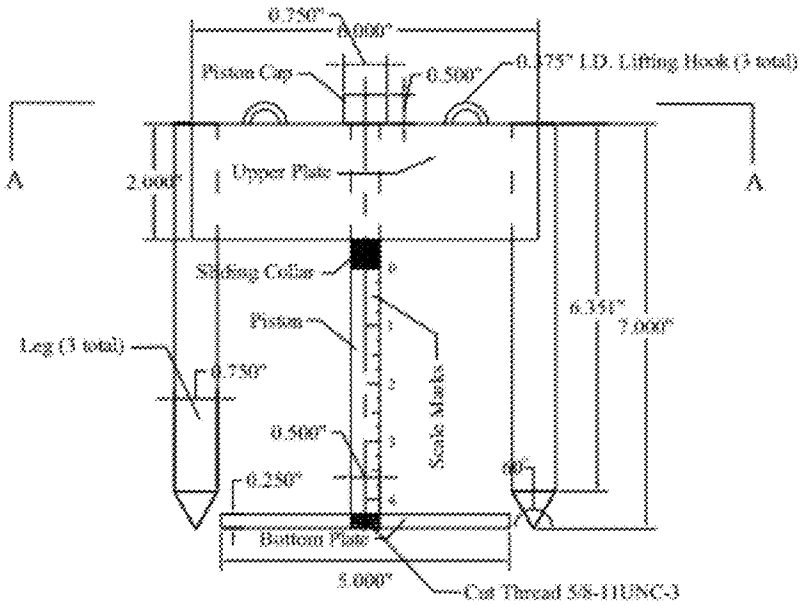
FIG. 5 is the design details A.

FIG. 5 is the design details A. The drawing shows all the dimension details and the connection method.

Figure 6:
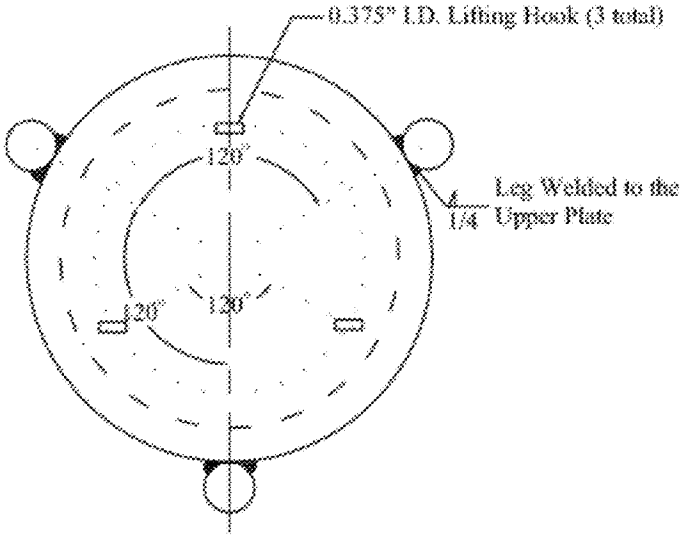
FIG. 6 is the design details B

FIG. 6 is the cross section view marked in FIG. 5.

Figure 7:
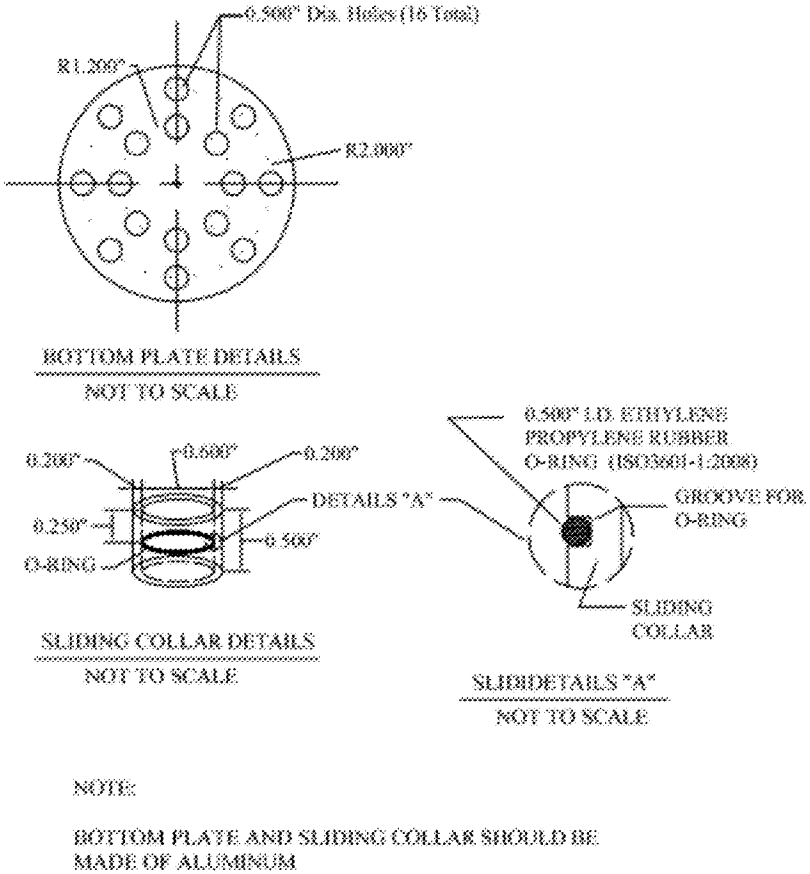
FIG. 7 is the design details C

FIG. 7 is the design details for the bottom plate and the sliding collar.

The invention claimed is:

1. An inspection device comprising an upper steel plate, three steel legs attached to the upper plate, a steel piston with imprinted marks, a sliding collar, a bottom plate with holes, three lifting holes attached to the upper plate for insertion into a borehole for measuring sediment thickness at the bottom of the hole.

2. The inspection device according to claim 1 wherein the upper plate comprises a 6" diameter and 2" thick steel plate.

3. The inspection device according to claim 1 wherein the piston comprises a 0.5" diameter steel bar with a 0.75 diameter cap on top of the bar as a stopper of the piston and bottom plate.

4. The inspection device according to claim 1 wherein the three legs comprises steel bars with 60 degree sharpened tips.

5. The inspection device according to claim 1 wherein the bottom plate comprises a 5" diameter and 0.25" thick aluminum plate with 16 holes of 0.5" diameter.

6. The inspection device according to claim 1 wherein the collar comprises a 0.5" long aluminum tube with a rubber 0.5" diameter O-ring embedded into a notch inside the tube.

7. A method of inspecting a borehole, either dry or into a slurry, by means of measuring the sediment thickness at the borehole bottom using said device of claim 1.

* * * * *